US007783231B2

(12) United States Patent
Yoshida

(10) Patent No.: US 7,783,231 B2
(45) Date of Patent: Aug. 24, 2010

(54) DEVELOPING DEVICE USED IN IMAGE FORMING APPARATUS, AND PROCESS CARTRIDGE WITH THE DEVELOPING DEVICE

(75) Inventor: Satoru Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 639 days.

(21) Appl. No.: 11/774,334

(22) Filed: Jul. 6, 2007

(65) Prior Publication Data

US 2008/0025761 A1 Jan. 31, 2008

(30) Foreign Application Priority Data

Jul. 31, 2006 (JP) ..... 2006-207635

(51) Int. Cl.
*G03G 15/08* (2006.01)

(52) U.S. Cl. ..... 399/254; 399/119; 399/252; 399/279

(58) Field of Classification Search ..... 399/119, 399/252, 254, 279
See application file for complete search history.

(56) References Cited

U.S. PATENT DOCUMENTS

| | | | | |
|---|---|---|---|---|
| 6,035,168 | A | 3/2000 | Masuda et al. | |
| 6,275,672 | B1 | 8/2001 | Blum et al. | |
| 2004/0076451 | A1 * | 4/2004 | Hirobe | 399/252 |
| 2007/0025773 | A1 * | 2/2007 | Tateyama et al. | 399/254 |
| 2007/0122202 | A1 * | 5/2007 | Taguma et al. | 399/254 |
| 2007/0134025 | A1 * | 6/2007 | Bessho | 399/254 |
| 2007/0160392 | A1 * | 7/2007 | Tsuda et al. | 399/254 |
| 2007/0274742 | A1 * | 11/2007 | Nakayama et al. | 399/254 |
| 2008/0267668 | A1 | 10/2008 | Sakata et al. | |
| 2009/0087214 | A1 | 4/2009 | Utsunomiya et al. | |

FOREIGN PATENT DOCUMENTS

| | | |
|---|---|---|
| DE | 29 49 398 A1 | 6/1980 |
| JP | 4-101179 | 4/1992 |
| JP | 4-85455 | 7/1992 |
| JP | 11-133710 | 5/1999 |
| JP | 11-167260 | 6/1999 |
| JP | 2004-77587 | 3/2004 |

* cited by examiner

*Primary Examiner*—David M Gray
*Assistant Examiner*—Ryan D Walsh
(74) *Attorney, Agent, or Firm*—Oblon, Spivak, McClelland, Maier & Neustadt, L.L.P.

(57) ABSTRACT

A developing device that has a reduced size and prevents a low-concentration developer to be drawn up to the developer carrier again, and further prevents the occurrence of irregularity of image density, and also a process cartridge and an image forming apparatus. A central axis of a developer supply device, a central axis of developer recovering device, and a central axis of a developer stirring/carrying device are positioned at an equal distance from a central axis of a developer carrier, as viewed cross-sectionally.

9 Claims, 6 Drawing Sheets

DEVELOPING DEVICE USED IN IMAGE FORMING APPARATUS, AND PROCESS CARTRIDGE WITH THE DEVELOPING DEVICE

BACKGROUND OF THE INVENTION

1. Field of the Invention

The present invention relates to a developing device that is configured to supply toner into a developer container containing a developer, a process cartridge having this developing device, and an image forming apparatus that uses either the developing device or the process cartridge.

2. Description of the Related Art

In a recent image forming apparatus such as an electrophotographic copier, facsimile device and printer, it has been requested to provide stability of image quality without causing density irregularities or the like even if an image with a high image-area ratio is printed continuously. Therefore, the functions of the developer carrying means of such image forming apparatus were divided to improve developer stirring performance by changing the arrangement of the developer carrying means from the conventional horizontal arrangement to vertical arrangement so that the developer carrying means on the lower side could recover the developer obtained after development from the developer carrier, and the developer carrying means on the upper side could supply developer to the developer carrier.

However, such change was not sufficient to stir the developer well, thus there was a problem that unevenness and reduction of concentration would occur.

Japanese Unexamined Publication No. H11-167260 discloses a developing device that comprises: a housing that stores two-component developer composed of toner and carrier; development means for magnetically carrying the two-component developer in the housing and applying the toner to electrostatic latent image carrier; a first carrying path that is provided in a position to supply the two-component developer to the development means within the housing, stirs/carries the two-component developer in a first direction along an axial direction of the development means, and has first developer carrying means for supplying the two-component developer to the development means; a second carrying path that is provided parallel to the first carrying path within the housing, recovers, from the development means, the two-component developer obtained after development, and has second developer carrying means for stirring/carrying the recovered developer in the same direction as the first direction; and a third carrying path that is provided parallel to the first carrying path, supplied with excessive developer supplied from the first carrying path to the development means and with the recovered developer from the second carrying path, has third developer carrying means for stirring/carrying the supplied excessive developer and the recovered developer in a second direction opposite to the first direction, and supplies, in a circulating manner, stirred developer obtained by mixing the excessive developer and recovered developer. In this apparatus, developer stirring performance was further improved by adding another developer carrying means and providing a stirring section besides the developer recovering section and developer supply section.

However, the problem was that, if the downstream side of the recovering section were excessively filled with the developer, low-concentration developer would be drawn up again into the developer carrier, causing irregularity of image density.

Technologies relating to the present invention are also disclosed in, e.g., Japanese Unexamined Publication No. H11-133710 and Japanese Unexamined Publication No. 2004-077587.

SUMMARY OF THE INVENTION

The present invention, therefore, is contrived in view of the above problems, and it is an object of the present invention to provide a developing device that has a reduced size and prevents a low-concentration developer to be drawn up to a developer carrier again, and further prevents the occurrence of irregularity of image density, and also to provide a process cartridge, and an image forming apparatus that uses the developing device and the process cartridge.

In an aspect of the present invention, a developing device comprises a developer carrier that carries a developer containing toner and carrier and develops a latent image formed on a latent image carrier; a developer container that contains the developer to be supplied to the developer carrier; a developer supply device for supplying the developer to the developer carrier; a developer restricting member that sets the thickness of the developer on the developer carrier to a thickness appropriate for development; a developer recovering device for recovering the developer separated from the developer carrier after necessary developer is applied to the latent image carrier; a developer stirring/carrying device, which is an alternative path for carrying the developer to a space between a section of the developer supply device and a section of the developer recovering device; an opening that communicates a downstream part of the developer stirring/carrying device with an upstream part of the developer supply device; and an opening that communicates an upstream part of the developer stirring/carrying device and a downstream part of the developer recovering device. A central axis of the developer supply device, a central axis of the developer recovering device, and a central axis of the developer stirring/carrying device are positioned at an equal distance from a central axis of the developer carrier, as viewed cross-sectionally.

In another aspect of the present invention, a process cartridge is used in an image forming apparatus and integrally supports a developing device, a photosensitive body and at least one of a charging device and a cleaning device. The process cartridge is detachably mounted on the main body of the image forming apparatus. The developing device comprises a developer carrier that carries a developer containing toner and carrier and develops a latent image formed on a latent image carrier; a developer container that contains the developer to be supplied to the developer carrier; a developer supply device for supplying the developer to the developer carrier; a developer restricting member that sets the thickness of the developer on the developer carrier to a thickness appropriate for development; a developer recovering device for recovering the developer separated from the developer carrier after necessary developer is applied to the latent image carrier; a developer stirring/carrying device, which is an alternative path for carrying the developer to a space between a section of the developer supply device and a section of the developer recovering device; an opening that communicates a downstream part of the developer stirring/carrying device with an upstream part of the developer supply device; and an opening that communicates an upstream part of the developer stirring/carrying device and a downstream part of the developer recovering device. A central axis of the developer supply device a central axis of the developer recovering device, and a central axis of the developer stirring/carrying device are positioned at an equal distance from a central axis of the developer carrier, as viewed cross-sectionally.

In another aspect of the present invention, an image forming apparatus has a developing device which comprises a developer carrier that carries a developer containing toner and carrier and develops a latent image formed on a latent image carrier; a developer container that contains the developer to be supplied to the developer carrier; a developer supply device for supplying the developer to the developer carrier; a developer restricting member that sets the thickness of the developer on the developer carrier to a thickness appropriate for development; a developer recovering device for recovering the developer separated from the developer carrier after necessary developer is applied to the latent image carrier; a developer stirring/carrying device, which is an alternative path for carrying the developer to a space between a section of the developer supply device and a section of the developer recovering device; an opening that communicates a downstream part of the developer stirring/carrying device with an upstream part of the developer supply device; and an opening that communicates an upstream part of the developer stirring/carrying device and a downstream part of the developer recovering device. A central axis of the developer supply device, a central axis of the developer recovering device, and a central axis of the developer stirring/carrying device are positioned at an equal distance from a central axis of the developer carrier, as viewed cross-sectionally.

In another aspect of the present invention, an image forming apparatus has a developing device which is integrally supported by a process cartridge. The developing device comprises a developer carrier that carries a developer containing toner and carrier and develops a latent image formed on a latent image carrier; a developer container that contains the developer to be supplied to the developer carrier; a developer supply device for supplying the developer to the developer carrier; a developer restricting member that sets the thickness of the developer on the developer carrier to a thickness appropriate for development; a developer recovering device for recovering the developer separated from the developer carrier after necessary developer is applied to the latent image carrier; a developer stirring/carrying device, which is an alternative path for carrying the developer to a space between a section of the developer supply device and a section of the developer recovering device; an opening that communicates a downstream part of the developer stirring/carrying device with an upstream part of the developer supply device; and an opening that communicates an upstream part of the developer stirring/carrying device and a downstream part of the developed recovering device. A central axis of the developer supply device, a central axis of the developer recovering device, and a central axis of the developer stirring/carrying device are positioned at an equal distance from a central axis of the developer carrier, as viewed cross-sectionally.

BRIEF DESCRIPTION OF THE DRAWINGS

The above and other objects, features, and advantages of the present invention will become more apparent from the following detailed description taken with the accompanying drawings, in which.

DESCRIPTION OF THE PREFERRED EMBODIMENTS

Before explaining the present invention, a conventional art and its problems are described first with reference to the drawings.

Figure 1:
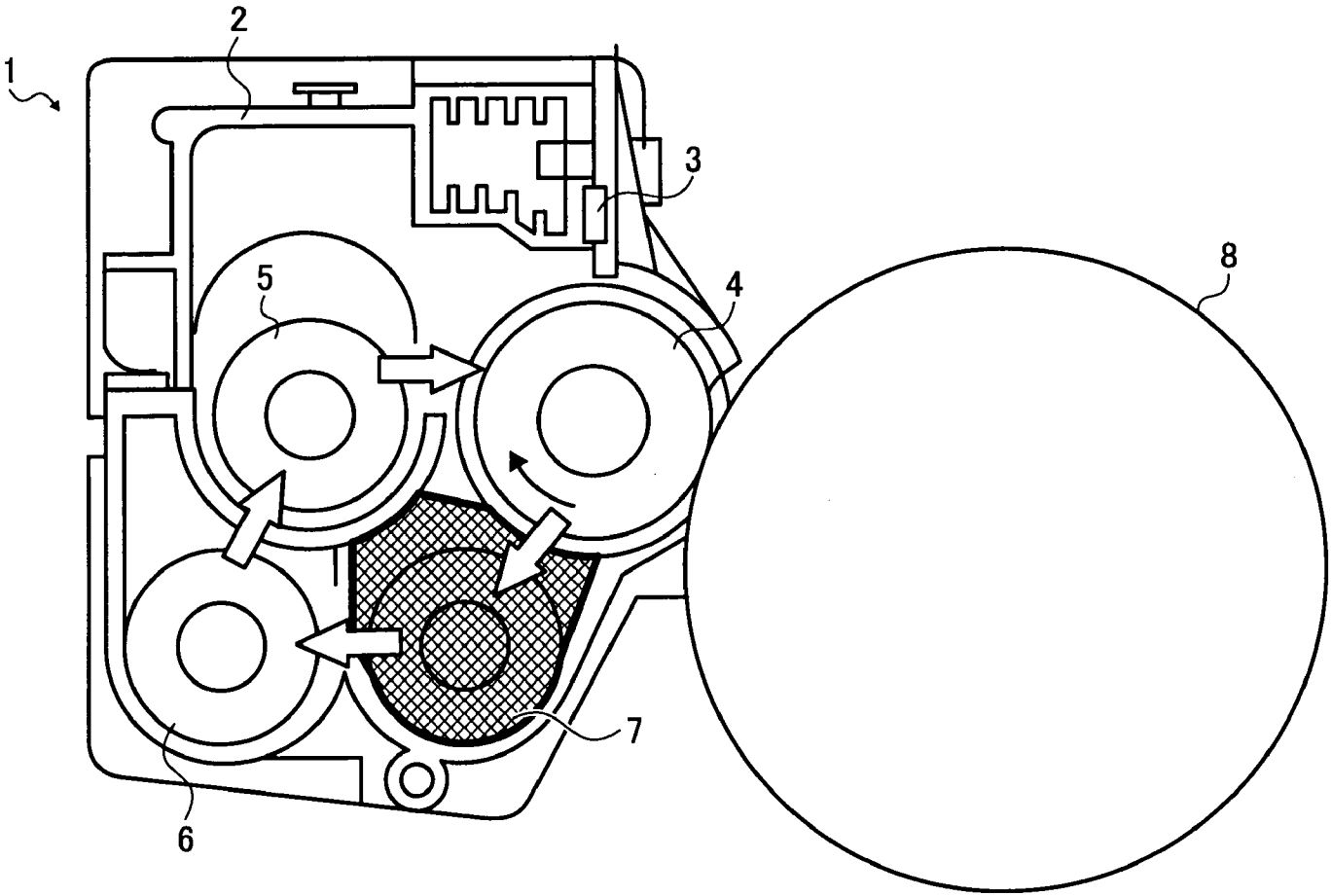
FIG. 1 PRIOR ART
FIG. 1 is a view showing a configuration of a conventional developing device which is used in an image forming apparatus comprising three developer carrying means.

FIG. 1 shows a configuration of a conventional developing device comprising three developer carrying means. Reference numeral 1 is a developing device mounted in an image forming apparatus such as a copying machine and laser printer. This developing device carries, to a photosensitive drum 8, a developer made strippable at a stainless development doctor 3 located on a developer carrier 4 to perform development. A surface of the developer carrier 4 is in the form of a V-shaped groove or sandblasted, and is composed of an aluminum pipe stock having a diameter of 25 mm. The gap between the development doctor 3 and photosensitive drum 8 is approximately 0.3 mm. The developer obtained after development is recovered by developer recovering means 7, carried to the front side as viewed in the cross section in FIG. 1, and transferred by developer stirring/carrying means 6 at a section having no partition member in a non-image area. Then, a toner is supplied from the upper side of the developer stirring/carrying means 6 in the vicinity of the section having no partition member.

The developer stirring/carrying means 6 carries the developer that has been recovered after development and the toner that has been supplied at a required amount, while dispersing the developer and toner to the far side as viewed in the cross section in FIG. 1. An opening section connected to developer supply means 5 is provided in the vicinity of the lowermost stream position of the developer stirring/carrying means 6, wherein the developer is lifted up from the bottom and transferred to the developer supply means 5. The developer is gradually supplied from its upstream side in the developer supply means 5 toward the developer carrier 4. An opening section connected to the developer stirring/carrying means 6 is provided in the vicinity of the lowermost stream section so that the developer is transferred from this opening section to the developer stirring/carrying means 6. Each developer carrying means is composed of a resin screw or a metallic screw. The diameter of each screw is set to ϕ22 mm, the screw pitch is set to 25 mm, and the number of revolutions is set to approximately 700 rpm.

Figure 2:
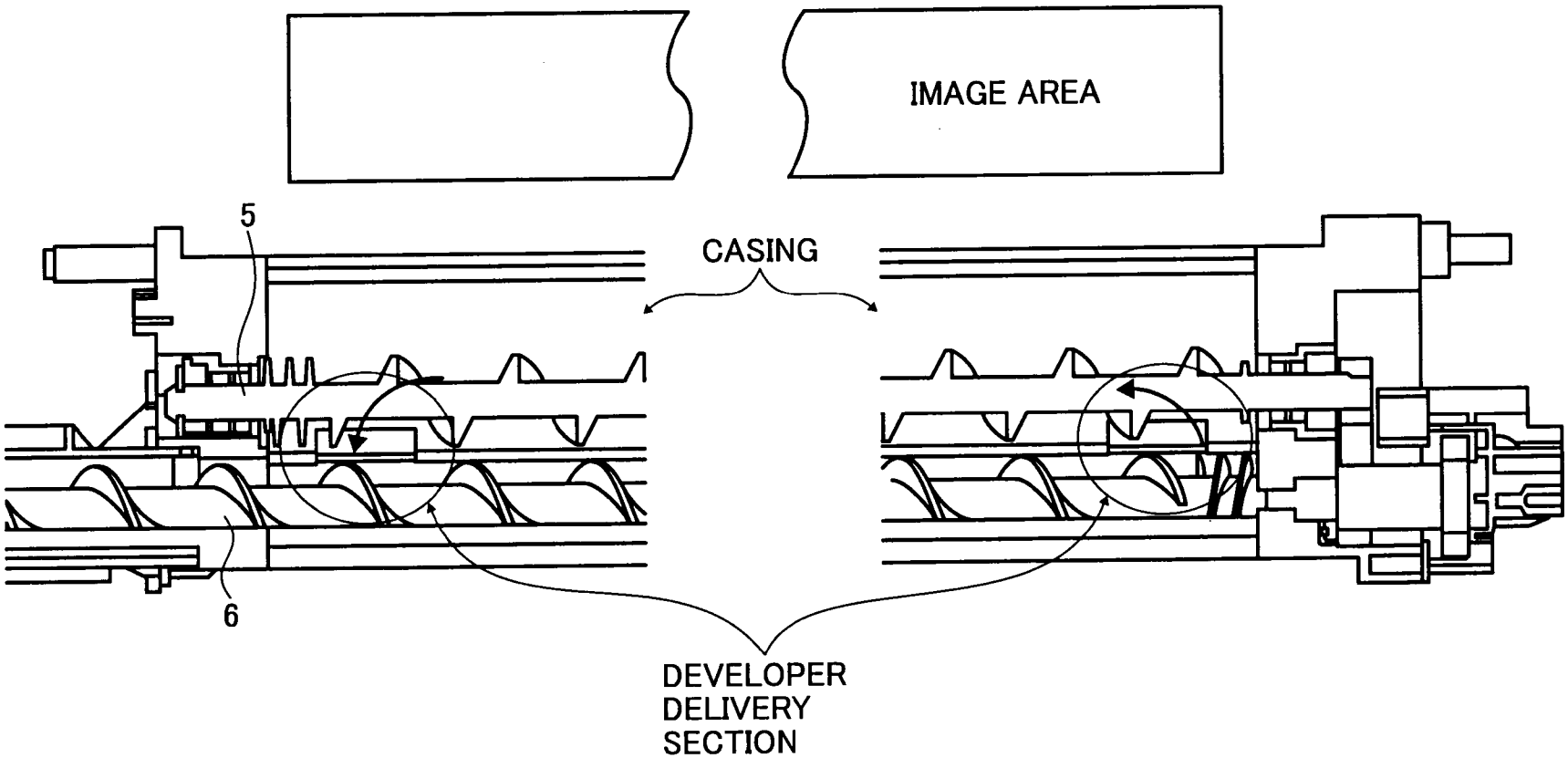
FIG. 2 PRIOR ART
FIG. 2 is a view showing the configuration of the developing device, as viewed in a longitudinal horizontal direction.

FIG. 2 shows a configuration of this developing device, as viewed in a longitudinal horizontal direction. As shown in the figure, a developer delivery section is provided in a section where the developer is lifted up from the developer stirring/carrying means 6 to the developer supply means 5, and in a section where the developer is dropped from the developer supply means 5 to the developer stirring/carrying means 6. These delivery sections are located within an image forming area illustrated in the form of a belt in the figure.

Figure 3:
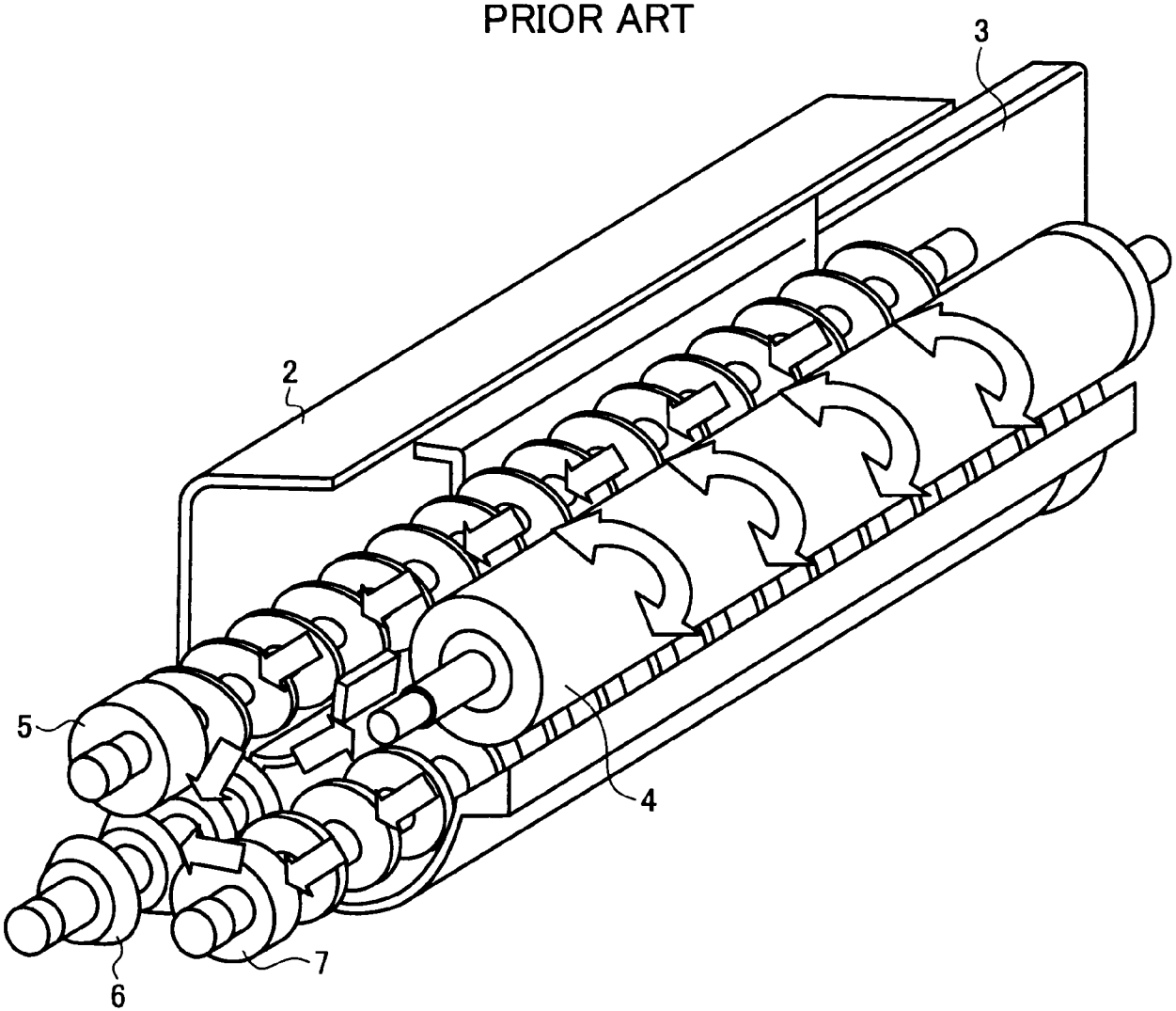
FIG. 3 PRIOR ART
FIG. 3 is a view showing the entire flow of a developer in the developing device.

FIG. 3 shows the entire flow of a developer. Each of the arrows shown in the figure indicates the direction of movement of the developer. The distance between a central axis of the developer supply means 5 and a central axis of the developer carrier 4 and the distance between a central axis of the developer recovering means 7 and the central axis of the developer carrier 4 are shorter than the distance between a central axis of the developer stirring/carrying means 6 and the central axis of the developer carrier 4. Therefore, the developer supply means 5 and the developer recovering means 7 are proximate to each other. In this case, there is a risk that the downstream part of the developer recovering means 7 is excessively filled with the developer, whereby low-concentration developer is drawn up to the developer carrier 4 again, causing irregularity of image density.

Next, the present invention that has solved the above problems of the conventional art is described with reference to the drawings.

Figure 4:
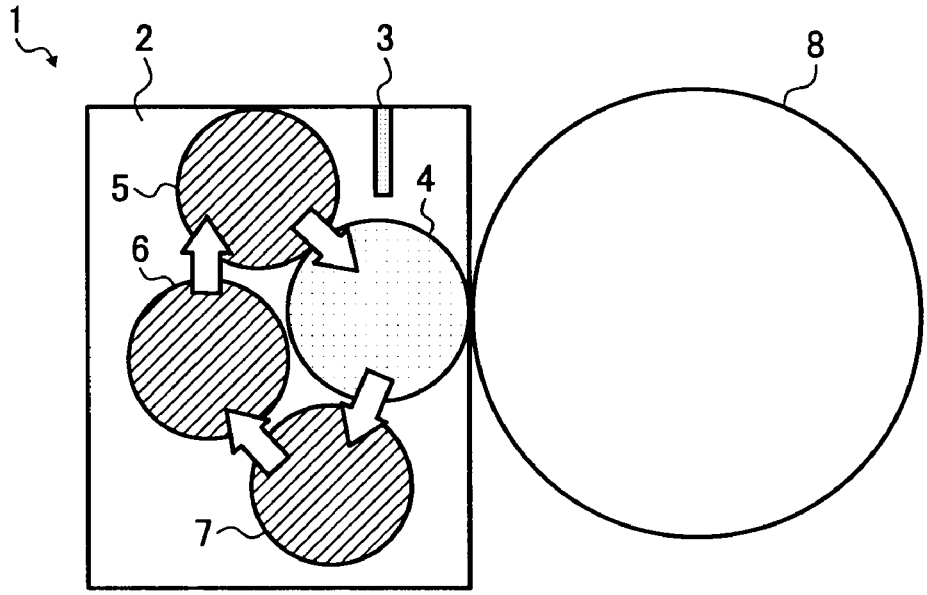
FIGS. 4 and 5 are views showing a configuration of a developing device according to an embodiment of the present invention.

FIG. 4 shows a configuration of a developing device according to an embodiment of the present invention. The cross-sectional view of this developing device 1 shows a case in which the central axis of the developer supply means 5, the central axis of the developer recovering means 7, and the central axis of the developer stirring/carrying means 6 are positioned at an equal distance from the central axis of the developer carrier 4. In this configuration, the developer supply means 5 and the developer recovering means 7 are positioned apart from each other by providing the developer stirring/carrying means 6 therebetween, thus low-concentration developer can be prevented from being drawn up to the developer carrier 4 again even if the downstream part of the developer recovering means 7 is excessively filled with developer. As a result, low-concentration developer is prevented from being drawn up to the developer carrier 4, and an unevenness of image density hardly occurs.

Accordingly, size reduction of the device can be attained, and low-concentration developer can be prevented from being drawn up to the developer carrier 4 by separating the developer supply means 5 and the developer recovering means 7 from each other.

Figure 5:
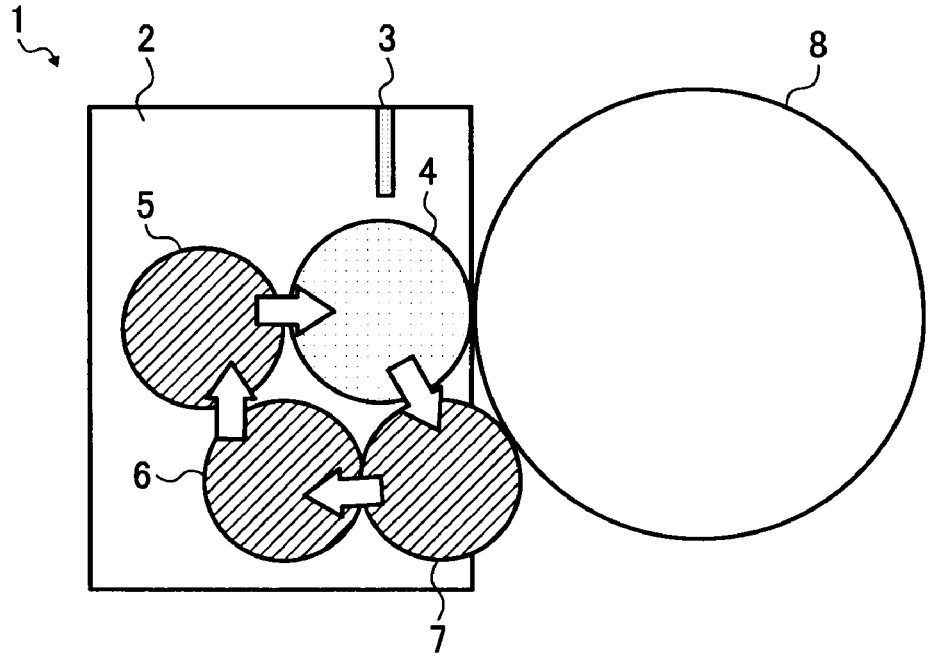

As shown in FIG. 5, in the developing device 1 the efficiency of delivering the developer from the developer recovering means 7 to the developer stirring/carrying means 6 is not diminished, because the developer recovering means 7 and the developer stirring/carrying means 6 are disposed horizontally. Specifically, the developer is delivered to the developer stirring/carrying means 6 thoroughly, whereby the developer can be prevented from leaking from the downstream part of the developer recovering means 7.

Therefore, size reduction of the apparatus can be attained, and efficiency of the delivery of the developer from the developer recovering means 7 to the developer stirring/carrying means 6 can be prevented from being diminished.

Figure 6:
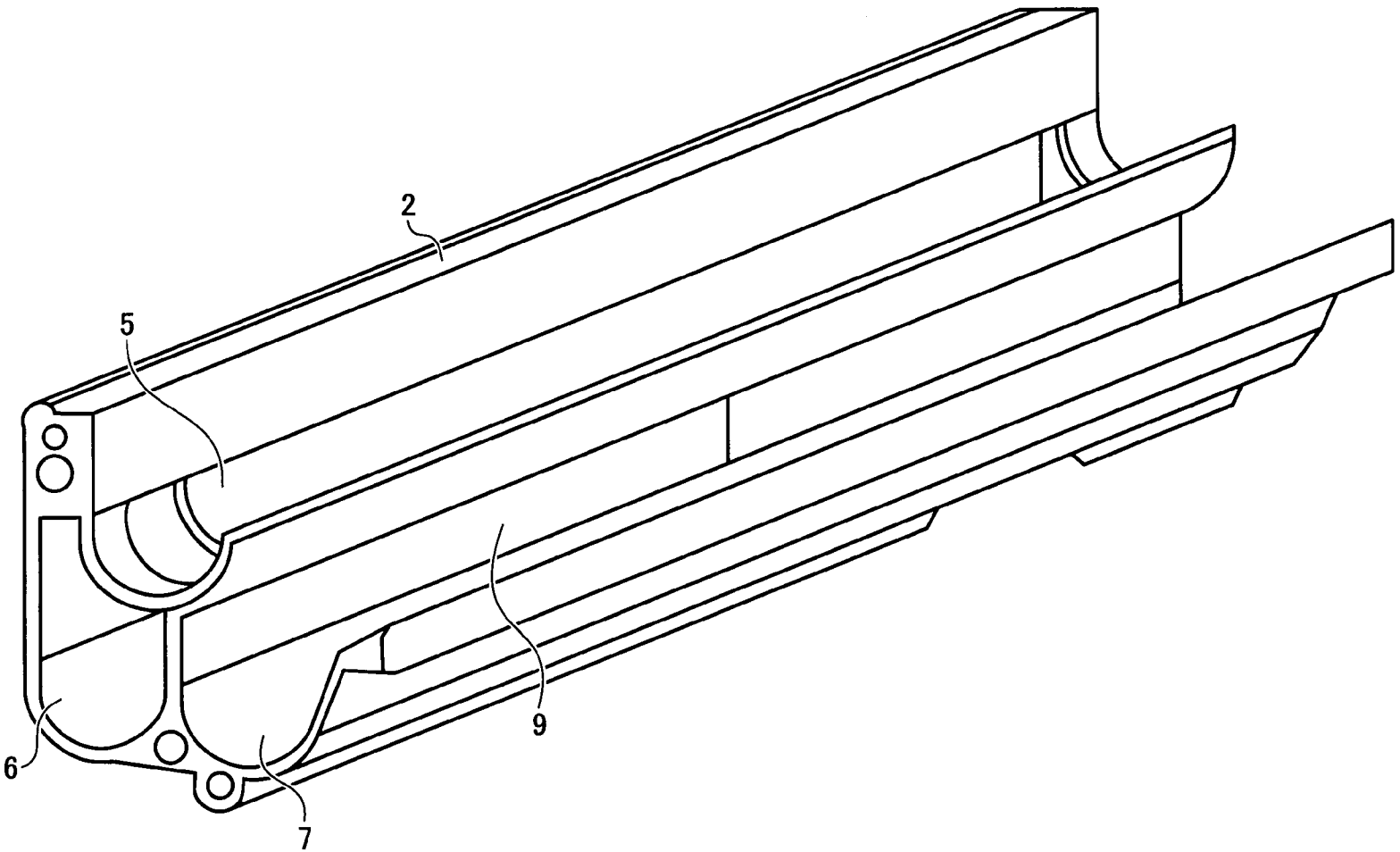
FIG. 6 is a view showing an opening provided in the developing device.

FIG. 6 shows an opening provided in the developing device 1. As shown in the figure, the developing device 1 is provided with an opening (bypass) 9 that communicates a part of an alternative path with a part of the developer recovering means. By means of this opening, the low-concentration developer can be prevented from being drawn up to the developer carrier 4 again. Moreover, the opening 9 that communicates the downstream part of the developer stirring/carrying means 6 with the upstream part of the developer supply means 5 is disposed inward with respect to the length of the axial direction of the developer carrier 4.

In the present embodiment, the opening (bypass) 9 that communicates a part of the developer stirring/carrying means 6 with a part of the developer recovering means 7 is disposed inward with respect to the length of the axial direction of the developer carrier 4. Therefore, even if the downstream part of the developer recovering means 7 within an image area is excessively filled with the developer, the opening (bypass) 9 can transfer some of the developer to the alternative path, thus the low-concentration developer can be prevented from being drawn up to the developer carrier 4 again.

Furthermore, in the present embodiment, the toner is replenished from the upstream part of the developer stirring/carrying means 6, whereby a carrying path for dispersing the replenished toner can be secured.

According to the present embodiment, as in the developing device 1 described above, excellent effects can be obtained in a process cartridge that is detachably mounted on the image forming apparatus main body, the process cartridge integrally supporting the developing device 1, photosensitive drum 8 and at least one of charging means and cleaning means.

Also, as with the developing device 1 described above, the excellent effects can be obtained in an image forming apparatus 100 having the developing device 1.

Moreover, as with the process cartridge, the excellent effects can be obtained in the image forming apparatus 100 having the process cartridge.

Figure 7:
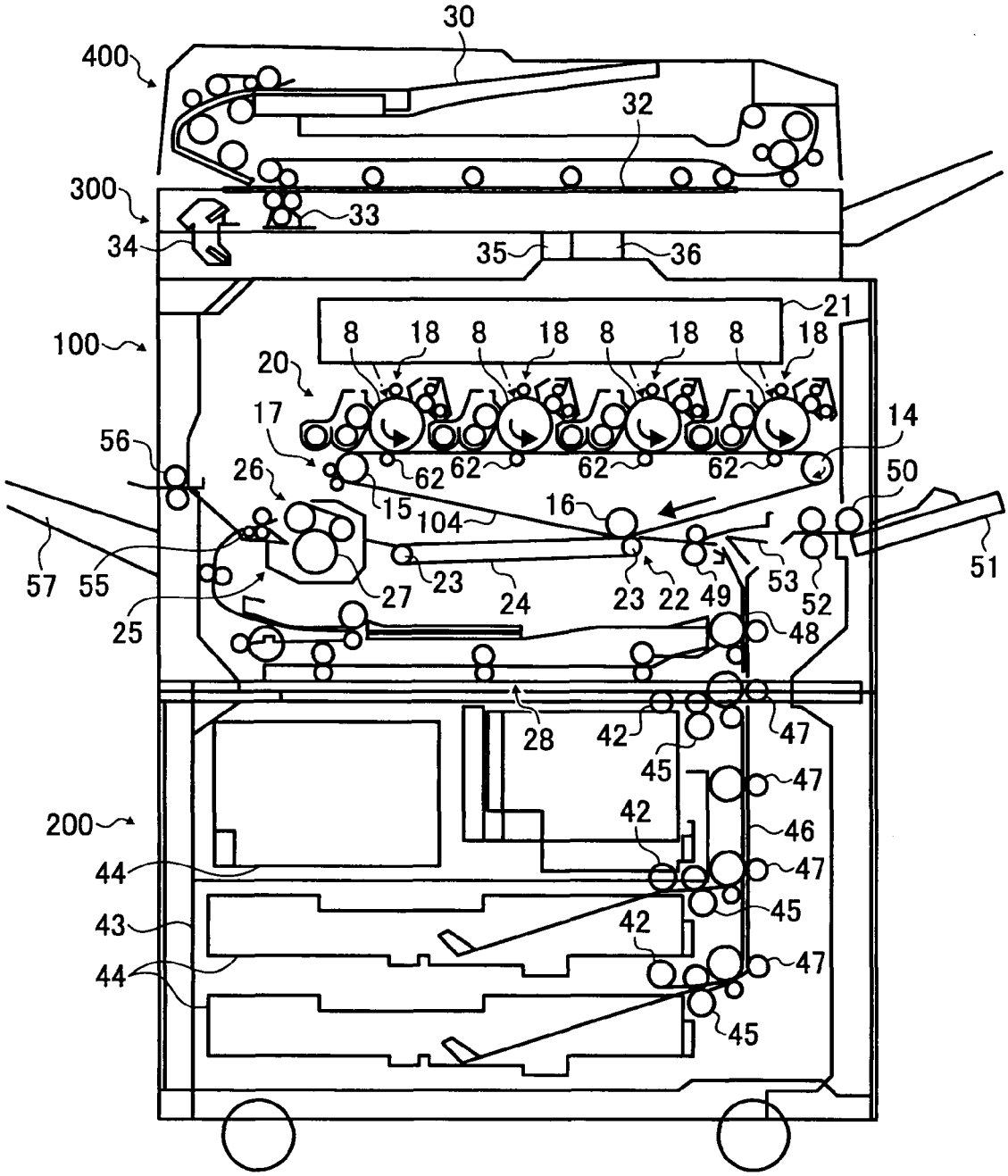
FIG. 7 is a view showing a configuration of an image forming apparatus to which the present invention is applied.

FIG. 7 shows a configuration of the image forming apparatus according to the present invention. Reference numeral 100 in the figure is an image forming apparatus main body, reference numeral 200 is a sheet feed table on which the image forming apparatus main body is placed, reference numeral 300 is a scanner mounted on the image forming apparatus main body 100, and reference numeral 400 is an automatic draft feeder (ADF) mounted on the scanner 300.

The image forming apparatus main body 100 is provided with an endless belt-like intermediate transfer body 104 at the center of the image forming apparatus main body. As shown in FIG. 7, the intermediate transfer belt 104 is wound around three support rollers 14, 15 and 16 in the illustrated example and is capable of rotating and conveying a sheet in a clockwise direction in the drawing.

In this illustrated example, the left-hand side of the second support roller 15 of the three support rollers is provided with an intermediate transfer body cleaning device 17 for removing residual toner that remains on the intermediate transfer body 104 after an image is transferred.

Furthermore, on the intermediate transfer body 104 extending between the first support roller 14 and the second support roller 15 of the three support rollers, four image forming means 18 for black, cyan, magenta and yellow are arranged horizontally along a conveying direction of the intermediate transfer body to construct a tandem image forming device 20.

As shown in FIG. 7, an exposure device 21 is provided above the tandem image forming device 20.

On the other hand, a secondary transfer device 22 is provided on the side opposite to the tandem image forming device 20 across the intermediate transfer body 104. The secondary transfer device 22 is constituted such that a secondary transfer belt 24, which is an endless belt, is wound around two rollers 23 in the illustrated example, and is pressed against the third support roller 16 via the intermediate transfer body 104 to transfer an image placed on the intermediate transfer body 104 to a sheet.

A fixing device 25 for fixing the transferred image on the sheet is provided on the side of the secondary transfer device 22. The fixing device 25 presses a pressure roller 27 against a fixing belt 26 which is an endless belt.

The secondary transfer device 22 also has a sheet carrying function for carrying a sheet to which an image is transferred to the fixing device 25. Of course, a non-contact charger may be disposed as the secondary transfer device 22, in which case it is difficult to provide the sheet carrying function along with the non-contact charger.

It should be noted in the illustrated example that a sheet turning device 28 for turning a sheet to record an image on both sides of the sheet is provided parallel to the tandem image forming device 20, below the secondary transfer device 22 and fixing device 25.

When copying using this color-image forming apparatus, a draft is set on the draft plate 30 of the automatic draft feeder 400. Alternatively, the automatic draft feeder 400 is opened to set a draft on a contact glass 32 of the scanner 300, and then the automatic draft feeder 400 is closed to hold the draft.

Then, a start switch, not shown, is pressed. When the draft is set in the automatic draft feeder 400, the draft is carried and moved onto the contact glass 32. When, on the other hand, the draft is set on the contact glass 32, the scanner 300 is driven immediately to cause the draft to move on a first moving body 33 and a second moving body 34. Then, light is projected from a light source of the first moving body 33. The light is then reflected from the surface of the draft, directed to the second moving body 34, and reflected off a mirror of the second moving body 34. The light then passes through an image lens 35 and enters a reading sensor 36, whereby the content of the draft is read.

Moreover, when the unshown start switch is pressed, one of the support rollers 14, 15 and 16 is rotary driven by a drive motor, not shown, and the other two support rollers are rotated by the drive of the abovementioned one of the rollers, whereby the intermediate transfer body 104 rotates to perform conveyance operation. At the same time, the individual image forming means 18 rotate the photosensitive drums 8 to form monochrome images in black, yellow, magenta and cyan, respectively. Thereafter, as the intermediate transfer body 104 performs the conveyance operation, these monochrome images are sequentially transferred, whereby a composite color image is formed on the intermediate transfer body 104.

On the other hand, when the unshown start switch is pressed, one of feed rollers 42 of the sheet feed table 200 is selected and rotated. Sheets are paid out from one of paper cassettes 44 provided in multi-stages in a paper bank 43. The sheets are separated one-by-one by a separating roller 45, and the separated sheet enters a sheet path 46. The sheet is then carried by a carrying roller 47, is guided to sheet path 48 within the image forming apparatus main body 100, is then caused to abut against a resist roller 49, and then stops.

Alternatively, a feed roller 50 is rotated to pay out sheets placed on a manual paper feeding tray 51. Then the sheets are separated one-by-one by a separating roller 52, and the separated sheet enters a sheet path 53. Similarly the sheet is caused to abut against the resist roller 49 and then stops.

Then, the resist roller 49 is rotated in accordance with the timing of the composite color image on the intermediate transfer body 104, and the sheet is sent to the space between the intermediate transfer body 104 and the secondary transfer device 22. The composite color image is transferred by the secondary transfer device 22 to record a color image on the sheet.

The sheet onto which the image is transferred is carried by the secondary transfer device 22 and sent to the fixing device 25. The fixing device 25 applies heat and pressure to the sheet to fix the transferred image. Thereafter, switching is made to a switching pawl 55 to discharge the sheet by means of a discharging roller 56, and the sheet is stacked on a sheet discharging tray 57. Alternatively, switching is made to the switching pawl 55 to send the sheet to the sheet turning device 28. The sheet is then turned by the sheet turning device and guided to the transfer position again, whereby the image is recorded on the reverse side of the sheet. Thereafter, the sheet is discharged onto the sheet discharging tray 57 by the discharging roller 56.

On the other hand, the intermediate transfer body 104 after image transfer prepares for the next image formation performed by the tandem image forming device 20, after the intermediate transfer body cleaning device 17 removes the residual toner that remains on the intermediate transfer body 104 after image transfer.

Furthermore, the process cartridge used in the image forming apparatus 100 and having the cleaning device can also be used, whereby an advantage of alleviating replacement work and the like can be obtained.

As described above, the present invention can use the means for solving the problems to provide the developing device that has a reduced size and prevents a low-concentration developer to be drawn up to the developer carrier again, and further prevents the occurrence of irregularity of image density, and also to provide the process cartridge and image forming apparatus.

Various modifications will become possible for those skilled in the art after receiving the teachings of the present disclosure without departing from the scope thereof.

What is claimed is:

1. A developing device, comprising:

a developer carrier that carries a developer containing toner and carrier and develops a latent image formed on a latent image carrier;

a developer container that contains the developer to be supplied to the developer carrier;

developer supply means for supplying the developer to the developer carrier;

a developer restricting member that sets the thickness of the developer on the developer carrier to a thickness appropriate for development;

developer recovering means for recovering the developer separated from the developer carrier after necessary developer is applied to the latent image carrier;

developer stirring/carrying means, which is an alternative path for carrying the developer to a space between a section of the developer supply means and a section of the developer recovering means;

an opening that communicates a downstream part of the developer stirring/carrying means with an upstream part of the developer supply means; and an opening that communicates an upstream part of the developer stirring/carrying means and a downstream part of the developer recovering means, wherein a central axis of the developer supply means, a central axis of the developer recovering means, and a central axis of the developer stirring/carrying means are positioned at an equal distance from a central axis of the developer carrier, as viewed cross-sectionally.

2. The developing device as claimed in claim 1, wherein the developer recovering means and the developer stirring/carrying means are disposed in a horizontal direction.

3. The developing device as claimed in claim 1, further comprising at least one opening that communicates a part of the developer stirring/carrying means with a part of the developer recovering means.

4. The developing device as claimed in claim 1, wherein the opening that communicates the downstream part of the developer stirring/carrying means with the upstream part of the developer supply means is disposed inward with respect to the length of an axial direction of the developer carrier.

5. The developing device as claimed in claim 1, wherein the opening that communicates a part of the developer stirring/ carrying means with a part of the developer recovering means is disposed inward with respect to the length of the axial direction of the developer carrier.

6. The developing device as claimed in claim 1, wherein the toner is replenished from the upstream part of the developer stirring/carrying means.

7. A process cartridge, which is used in an image forming apparatus, integrally supports a developing device, a photosensitive body and at least one of charging means and cleaning means, and is detachably mounted on the main body of the image forming apparatus, the developing device comprising:

a developer carrier that carries a developer containing toner and carrier and develops a latent image formed on a latent image carrier;

a developer container that contains the developer to be supplied to the developer carrier;

developer supply means for supplying the developer to the developer carrier;

a developer restricting member that sets the thickness of the developer on the developer carrier to a thickness appropriate for development;

developer recovering means for recovering the developer separated from the developer carrier after necessary developer is applied to the latent image carrier;

developer stirring/carrying means, which is an alternative path for carrying the developer to a space between a section of the developer supply means and a section of the developer recovering means;

an opening that communicates a downstream part of the developer stirring/carrying means with an upstream part of the developer supply means; and an opening that communicates an upstream part of the developer stirring/carrying means and a downstream part of the developer recovering means, wherein a central axis of the developer supply means, a central axis of the developer recovering means, and a central axis of the developer stirring/carrying means are positioned at an equal distance from a central axis of the developer carrier, as viewed cross-sectionally.

8. In an image forming apparatus having a developing device, the developing device comprising:

a developer carrier that carries a developer containing toner and carrier and develops a latent image formed on a latent image carrier;

a developer container that contains the developer to be supplied to the developer carrier;

developer supply means for supplying the developer to the developer carrier;

a developer restricting member that sets the thickness of the developer on the developer carrier to a thickness appropriate for development;

developer recovering means for recovering the developer separated from the developer carrier after necessary developer is applied to the latent image carrier;

developer stirring/carrying means, which is an alternative path for carrying the developer to a space between a section of the developer supply means and a section of the developer recovering means;

an opening that communicates a downstream part of the developer stirring/carrying means with an upstream part of the developer supply means; and an opening that communicates an upstream part of the developer stirring/carrying means and a downstream part of the developer recovering means, wherein a central axis of the developer supply means, a central axis of the developer recovering means, and a central axis of the developer stirring/carrying means are positioned at an equal distance from a central axis of the developer carrier, as viewed cross-sectionally.

9. In an image forming apparatus having a developing device which is integrally supported by a process cartridge, the developing device comprising:

a developer carrier that carries a developer containing toner and carrier and develops a latent image formed on a latent image carrier;

a developer container that contains the developer to be supplied to the developer carrier;

developer supply means for supplying the developer to the developer carrier;

a developer restricting member that sets the thickness of the developer on the developer carrier to a thickness appropriate for development;

developer recovering means for recovering the developer separated from the developer carrier after necessary developer is applied to the latent image carrier;

developer stirring/carrying means, which is an alternative path for carrying the developer to a space between a section of the developer supply means and a section of the developer recovering means;

an opening that communicates a downstream part of the developer stirring/carrying means with an upstream part of the developer supply means; and an opening that communicates an upstream part of the developer stirring/carrying means and a downstream part of the developer recovering means, wherein a central axis of the developer supply means, a central axis of the developer recovering means, and a central axis of the developer stirring/carrying means are positioned at an equal distance from a central axis of the developer carrier, as viewed cross-sectionally.

* * * * *